United States Patent [19]

Crystal

[11] 4,425,045

[45] Jan. 10, 1984

[54] PRINT WHEEL FOR USE WITH AN ALIGNMENT PRINT HAMMER

[75] Inventor: Richard G. Crystal, Los Altos, Calif.

[73] Assignee: Xerox Corporation, Stamford, Conn.

[21] Appl. No.: 62,609

[22] Filed: Aug. 1, 1979

[51] Int. Cl.[3] ..... B41J 1/30

[52] U.S. Cl. ..... 400/144.2; 400/174

[58] Field of Search ..... 400/144.2, 144.3, 174, 400/175

[56] References Cited

U.S. PATENT DOCUMENTS

| | | | |
|---|---|---|---|
| 3,643,774 | 2/1972 | Kondur | 400/144.3 |
| 3,840,105 | 10/1974 | Kittredge | 400/144.2 |
| 3,946,852 | 3/1976 | Watson et al. | 400/144.3 |
| 3,970,186 | 7/1976 | Sohl et al. | 400/144.2 |
| 4,060,162 | 11/1977 | Frechette | 400/144.2 |

OTHER PUBLICATIONS

IBM Tech. Disc. Bulletin, J. H. Meier et al., vol. 17, No. 5, Oct. 1974, p. 1316.

*Primary Examiner*—Paul T. Sewell
*Attorney, Agent, or Firm*—Richard A. Tomlin

[57] ABSTRACT

A print wheel for use in a serial printing system wherein print heads are provided with alignment surfaces corresponding to alignment surfaces on the print hammer. A beam retarder is utilized to assure that the alignment surfaces are firmly mated.

1 Claim, 2 Drawing Figures

PRINT WHEEL FOR USE WITH AN ALIGNMENT PRINT HAMMER

The invention relates to serial printing devices and more particularly to high-speed serial printers having print fonts arranged upon a disc member, which rotates the fonts past an impacting printing hammer. In a high-speed, high-quality printing system, it is necessary to accurately position the disc member so that the printed characters will be aligned and spaced correctly. Heretofore, expensive and complicated systems have been utilized to provide the positional accuracy required. Attempts to utilize inexpensive stepper motors to position print wheels, such as the print wheel shown in U.S. Pat. No. 3,970,186, issued July 20, 1976, to Gordon Sohl et al, entitled "Damper for a Composite Print Wheel", were not totally successful.

One method for aligning misaligned fonts before the font strikes the print ribbon is to utilize shaped hammers and print heads as shown in U.S. Pat. No. 3,840,105, issued Oct. 8, 1974, to Lloyd G. Kittredge, entitled "Guide and Alignment Member". An attempt was made to use the method of alignment shown in the Kittredge patent with the composite print wheel as shown in the Sohl patent. It was found, however, that the composite print wheel's double ring fabric damper resisted lateral movement of the print head as did the beam on which the print head rode. Also, the beam being so thin did not provide enough resistance to force the print head into the print hammer far enough to provide accurate registration.

The invention as claimed is intended to provide a remedy. It solves the problem of how to utilize inexpensive stepper motors in high-speed printers without sacrificing quality. The print wheel of this invention is provided with a disc, which acts both as a beam dampener to dampen vibration and acts also to provide the resistance necessary to cause the print head to seat in the print hammer.

One way of carrying out the invention is described in detail below with reference to the drawing, which illustrates one specific embodiment.

Figure 1:
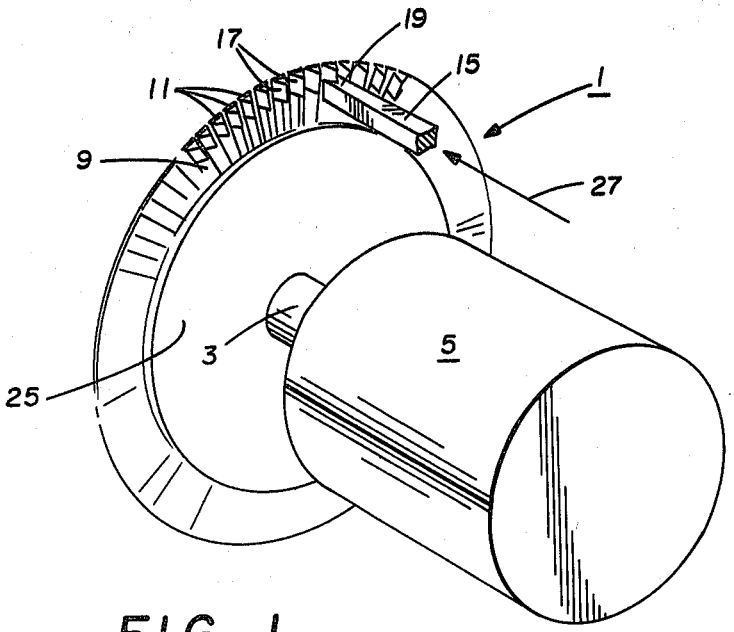
FIG. 1 is a perspective view of the disc print wheel member of this invention showing its relationship to the print alignment hammer and motor.
Figure 2:
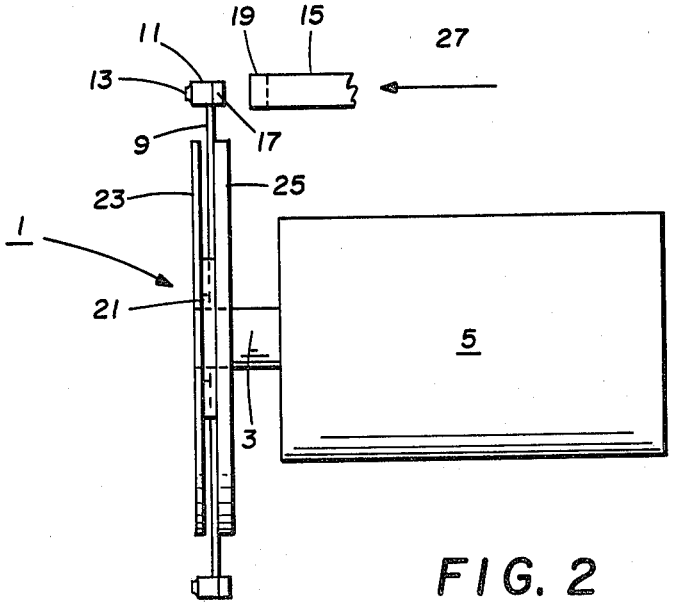
FIG. 2 is a cross-sectional side view of a print wheel in accordance with this invention.

In the two figures, the same reference numbers are used to refer to similar parts. Referring now to the drawing, there is seen a serial printing apparatus made up of a print wheel shown generally as 1. The print wheel 1 is mounted for rotation on shaft 3 of stepper motor 5. Stepper motor 5 can move wheel 1 in either a clockwise or counterclockwise direction. Print wheel 1 contains a plurality of outward extending beams or spokes 9 having print heads 11 formed thereon. On one face of print heads 11 are formed print characters 13. The face of print head 11 facing alignment print hammer 15 is dihedral alignment surface 17 shaped to fit into the dihedral alignment opening 19 in alignment print hammer 15. The beams or spokes are bonded in hub 21 (FIG. 2), which has an opening therein for motor shaft 3. Cemented to the front face of hub 21 is flexible disc 23. Disc 25 is optionally provided to act as a back stop for beams 9 when hammer 15 is returned from striking print head 11.

The system operates as follows: Stepper motor 5 causes disc 1 to rotate to a position where the character 13 to be printed is roughly aligned with print hammer 15. As print hammer 15 moves forward being driven by, for example, a solenoid in the direction shown by arrow 27, the male alignment dihedral section 17 on print head 11 comes in contact with female alignment dihedral section 19 on hammer 15. Beam 9 with print head 11 on it is forced in the forward direction shown by arrow 27 until it contacts beam retarding disc 23. Retarding disc 23 provides increased resistance to the forward movement of beam 9 assuring that male dihedral 17 sits firmly in hammer female alignment dihedral 19 assuring accurate alignment of print head 11 and character 13 when character 13 strikes the print ribbon (not shown). It can also be seen that since beam 9 is not attached to disc 23, disc 23 will not seriously interfere with the lateral movement of beam 9. Disc 23 also gives increased "handleability", the beams 9 not being so easily damaged by handling. This increased handleability also means that thinner beams 9 may be used ensuring the ability to move the spokes laterally even further, which provides increased misalignment tolerance. Optionally, disc 25 is used as a back stop for beam 9 preventing or decreasing beam vibration, which is always present in such systems.

All such modifications as naturally occur to those skilled in the art are deemed to fall within the scope of the invention as defined by the claims. The illustrative embodiment depicted in the attached drawing is considered merely as an exemplary representation of one of the ways of practicing the invention. For example, discs 23 and 25 can be replaced by a ring. Similarly, disc 23 may be replaced by a separate flexible member placed in the path of beam 9 and supported by a separate member.

What is claimed is:

1. A print wheel for use with an alignment print hammer, said print wheel comprising beams extending radially outward from a hub, said beams having print heads attached thereto, said print heads having a print character on one face thereof and an alignment surface on the surface of said print head opposite said print character to contact an alignment surface of said alignment print hammer characterized in that a flexible beam retarding means is located in spaced apart planar relationship parallel to the plane formed by the radially extending beams and positioned to be contacted by a beam after said beam has been acted on by said print hammer and to be out of contact with said beams when said beams are not being acted on by said alignment print hammer.

* * * * *